US006379114B1

(12) United States Patent
Schott et al.

(10) Patent No.: US 6,379,114 B1
(45) Date of Patent: Apr. 30, 2002

(54) METHOD FOR SELECTING THE PITCH OF A CONTROLLABLE PITCH MARINE PROPELLER

(75) Inventors: Carl G. Schott, Fond du Lac; Blake R. Suhre, Neenah; Matthew J. Manthey, Fond du Lac, all of WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 09/721,236

(22) Filed: Nov. 22, 2000

(51) Int. Cl.[7] ..... B63H 3/00

(52) U.S. Cl. ..... 416/1; 416/27; 416/30; 416/35

(58) Field of Search ..... 416/1, 27, 30, 416/35, 155, 162; 440/1, 50

(56) References Cited

U.S. PATENT DOCUMENTS

| | | | | | |
|---|---|---|---|---|---|
| 3,589,830 | A | * | 6/1971 | Mogren | 416/1 |
| 4,347,039 | A | | 8/1982 | Houghton | 416/167 |
| 4,533,296 | A | | 8/1985 | Duchesneau et al. | 416/46 |
| 4,599,043 | A | | 7/1986 | Muller | 416/162 |
| 4,639,192 | A | | 1/1987 | Harrell | 416/27 |
| 4,744,727 | A | | 5/1988 | Muller | 416/93 |
| 4,880,402 | A | | 11/1989 | Muller | 440/50 |
| 5,174,718 | A | | 12/1992 | Lampeter et al. | 416/48 |
| 5,226,844 | A | | 7/1993 | Muller | 440/50 |
| 5,299,911 | A | * | 4/1994 | Moriya | 416/35 |
| 5,413,461 | A | * | 5/1995 | Johnsen | 416/1 |
| 5,415,523 | A | | 5/1995 | Muller | 416/35 |
| 5,795,132 | A | * | 8/1998 | Wheeler | 416/147 |

OTHER PUBLICATIONS

"Application of Modern Digital Controls to Improve the Operational Efficiency of Controllable Pitch Propellers" by Robert A. Morvillo, SNAME Transactions, vol. 104, in 1996, pp115–136.

* cited by examiner

*Primary Examiner*—Edward K. Look
*Assistant Examiner*—Ninh Nguyen
(74) *Attorney, Agent, or Firm*—William D. Lanyi

(57) ABSTRACT

A control algorithm provides a method for selecting a pitch magnitude for a controllable pitch propeller. The pitch magnitude is selected as a function of the difference between a desired engine speed and an actual engine speed in addition to the actual pitch position of the controllable pitch propeller. The desired engine speed is selected as a function of the position of either a throttle control lever or the throttle plate of an internal combustion engine.

20 Claims, 7 Drawing Sheets

METHOD FOR SELECTING THE PITCH OF A CONTROLLABLE PITCH MARINE PROPELLER

BACKGROUND OF THE INVENTION

1. Field of the Invention

The present invention is generally related to a method for selecting the pitch of a controllable pitch marine propeller and, more particularly, to a method for selecting the pitch of a controllable pitch propeller based on a magnitude of an input parameter which is used to select a desired magnitude of an engine operating characteristic as a function of the input parameter, after which the pitch of the controllable pitch marine propeller is selected as a function of changes in the magnitude of the engine operating characteristic.

2. Description of the Prior Art

Conventional propellers used in conjunction with planing watercraft often experience large changes in operating conditions throughout the range of boat speed at which they are operated. These changes in watercraft operating conditions, in turn, cause large variations in the propeller's torque characteristics as a function of engine speed. Unlike automobiles, watercraft typically do not have multi-speed transmissions that allow the load to be adjusted to match the power characteristics of an associated internal combustion engine, so the engine used in a watercraft must be able to accept many different load changes. In practice, it is typical that the propeller load variations seriously limits engine performance in many common situations, although these variations usually are not sufficient to actually stall or overspeed the engine. The fact that propeller load is different at different boat speeds implies that a propeller which is selected to give optimal performance on one boat speed will differ from another propeller that is chosen for optimal engine performance at a different boat speed. Therefore, performance compromises are inherent in choosing conventional propellers for a planing watercraft. In other words, a conventional propeller chosen for best high speed performance would typically compromise low speed acceleration, and vice versa.

U.S. Pat. No. 4,639,192, which issued to Harrell on Jan. 27, 1987, describes a propeller pitch controlling arrangement having a fuel economizing feature. The arrangement has a fuel economizer feature for use on marine vessels and has a mode selector valve operable to a normal mode and an economizer mode. In the economizer mode, a first pilot signal is transmitted to a path selector valve to establish a first flow path to a propeller pitch servomechanism. A second pilot signal is transmitted from a relay valve when the marine vessel speed drops below a predetermined value. The second pilot signal moves the path selector valve to a second position establishing a second flow path to the propeller pitch servomechanism. A first selected fluid pressure from a regulating valve arrangement mechanically linked to the engine fuel rack, is directed to the propeller pitch servomechanism when the first flow path is established. This first selected fluid path is proportional to the movement of the engine fuel rack. A second selected fluid pressure transmitted from a pitch control valve, is directed to the propeller pitch servomechanism when the second flow path is established.

U.S. Pat. No. 5,415,523, which issued to Muller on May 16, 1995, describes a control system for a variable pitch boat propeller. A marine drive is provided with a propeller that is rotatable about a drive axis and has a plurality of blades. The blades are pivotable about respective blade axes projecting generally radially from the drive axis and each blade is movable between a low pitch end position extending generally parallel to a plane perpendicular to the drive axis and a high pitch end position extending at a large acute angle to the plane.

U.S. Pat. No. 4,744,727, which issued to Muller on May 17, 1988, describes a controllable pitch propeller and watercraft drive. The propeller assembly has an inner housing attached to a main driveshaft, the housing having rails on the outer surface thereof. Modules carrying the propeller blades are mounted positively on the rails, with each module having a housing receiving a hub cylinder and bushings axially aligned at opposite sides thereof. Each pair of bushings receives an adjusting piston having an adjusting pin which engages a groove forming a control path in a propeller hub. Each blade is adjusted by a control lever which adjusts each adjusting piston through a mechanical linkage including an adjusting sleeve and a thrust bearing and flange. The hub is provided with open spaces formed between the inner and outer housings to create exhaust ducts through the hub.

U.S. Pat. No. 5,174,718, which issued to Lampeter et al on Dec. 29, 1992, describes a blade pitch change control system. The system is used for adjusting the pitch of a variable pitch propeller blade operatively connected for pitch change to a pitch change actuator piston. A pitch change control system is operatively connected to the pitch change actuator piston for selectively pressuring the pitch change actuator piston to effectuate a desired change in the pitch of the propeller blades.

U.S. Pat. No. 5,226,844, which issued to Muller on Jul. 13, 1993, describes an actuator for a variable pitch propeller. It describes a drive for a boat which has a propeller hub rotatable about a main axis extending in a normal travel direction, a plurality of blades projecting generally radially from the main axis of the hub, and each blade being pivotal so as to be of variable pitch, with respective blade rods extending axially and displaceable axially relative to the hub to vary the pitch of the blades. A stator carried on the boat downstream in the direction from the hub and nonrotatable about the axis rotatably supports a cylinder housing that is releasably connected to the rods for joint axial movement therewith.

U.S. Pat. No. 4,347,039, which issued to Houghton on Aug. 31, 1982, describes a variable pitch screw propeller. The propeller has a crank arm attached to the shaft of each propeller blade and a telescoping drive arm having one end pivotally attached to the propeller hub and the other end pivotally attached to a control rod. The telescoping arm rotates the crank arm to adjust the pitch of the propeller blades to an angle substantially greater than 90 degrees as the control rod is moved longitudinally along a longitudinal axis of the hub of the propeller.

U.S. Pat. No. 4,533,296, which issued to Duchesneau et al on Aug. 6, 1985, describes a pitch control system for a variable pitch propeller. The control system has a mechanical low pitch stop which includes an electrical backup. The backup comprises an electrically operable means to effect blade pitch adjustment toward feather under conditions of failure of low pitch stop indicated by propeller operation at pitch angles in the range of beta operation, but power settings in the range of normal engine speed governor pitch control. Such operating conditions actuate a pair of switches connecting the means to a voltage source to increase blade pitch toward feather, thereby preventing overspeed operation of the propeller.

U.S. Pat. No. 4,599,043, which issued to Muller on Jul. 8, 1986, describes a controllable pitch propeller and watercraft drive. The propeller assembly has an inner housing attached to a main driveshaft, the housing having rails on the outer surface thereof. Modules carrying the propeller blades are positively mounted on the rails, each module having a housing receiving a hub cylinder and bushings axially aligned at opposite sides thereof. Each pair of bushings receives an adjusting piston having an adjusting pin which engages a groove forming a control path in a propeller hub. Each blade is adjusted by a control lever which adjusts each adjusting piston through a mechanical linkage including an adjusting sleeve and a thrust bearing and flange.

U.S. Pat. No. 4,880,402, which issued to Muller on Nov. 14, 1989, describes a method and apparatus for preventing the attachment of foreign bodies to controllable pitch propeller linkages of watercraft. The watercraft has a rotatable propeller drive shaft connected to a driving engine. A coupling is slidably disposed along the shaft. The coupling has a rotatable first section secured to the shaft and a non-rotatable second section spaced from the shaft with a bearing arrangement in which the first section is rotatably disposed. A variable pitch propeller has a hub secured to the shaft. A plurality of propeller blades are rotatably disposed in bearing housings to the hub. Connecting rods are slidably disposed in the bearing housings. Each connecting rod has a position of protection at which it is disposed completely in the corresponding bearing housing wherein it cannot be attacked by foreign bodies.

The patents described above are hereby expressly incorporated by reference in the description of the present invention.

An article, titled "Application of Modern Digital Controls to Improve the Operational Efficiency of Controllable Pitch Propellers" by Robert A. Morvillo, was published in SNAME Transactions, Vol. 104, in 1996, at pp. 115–136. This article, describes control systems designs intended for use with fishing trawlers, Great Lakes Bulk Carriers, and a Hopper Dredge. It discusses the applications of a state of the art electronic control system that further exploits the capabilities of controllable pitch propellers. In contrast to a fixed pitch propeller, where the propeller thrust is a function of the only independent variable, shaft rotational speed, the controllable pitch propeller has infinite combinations of pitch and engine speed for a given thrust requirement. This paper considers the design of a robust, multi-parameter propulsion control system with the ability to determine the ideal pitch and engine speed combination in real time for varying operating conditions. Because the design goals of the control system are optimum fuel economy as well as the usual stability and response criteria of most control systems, a steady state model combining the characteristics of the propeller, hull, and prime mover is discussed. In addition, the paper provides a dynamic analysis to ensure acceptable stability and response characteristics of the control system.

Planing watercraft experience wide ranges of conditions under which they are expected to operate. For example, if a planing watercraft is accelerated from a standstill position to a planing condition at wide open throttle, optimum performance of the watercraft requires that it exhibit sufficient acceleration to move the watercraft from a standstill to a speed that is able to achieve planing of the watercraft. Once on plane, the propulsion system must be adequate to increase the speed in an efficient manner to obtain the maximum speed of the watercraft on plane when the engine is operated at wide open throttle.

It would be significantly beneficial if a control system could be provided that allows efficient selection of pitch, in a dynamic manner, that maximizes the performance of the engine of the watercraft as the watercraft experiences a wide variety of operating conditions.

SUMMARY OF THE INVENTION

A method for selecting the pitch of a controllable pitch marine propeller of a planing watercraft, in accordance with a preferred embodiment of the present invention, comprises the step of determining a magnitude of an input parameter. The input parameter, in a particularly preferred embodiment of the present invention, is a manually controlled input parameter such as a throttle lever position or a throttle plate position. The method further comprises the step of selecting a desired magnitude of an engine operating characteristic as a function of the input parameter. The engine operating characteristic in a preferred embodiment is engine speed, measured in revolutions per minute (RPM). The desired magnitude of the engine operating characteristic, or engine speed, can be selected from a lookup table as a function of the input parameter, or manually controlled throttle lever. The method of the present invention further comprises the step of measuring an actual magnitude of the engine operating characteristic, such as engine speed. The present invention also comprises the step of determining a desired change in the pitch of the controllable pitch propeller as a function of the difference between the desired magnitude of the engine operating characteristic and the actual magnitude of the engine operating characteristic. In other words, if the input parameter indicates a desired engine speed that differs from the measured actual engine speed, the desired change in pitch would be determined as a function of that difference between the desired and actual magnitudes of the engine speed.

The present invention, as part of the method for selecting the pitch of the controllable pitch marine propeller, can further comprise the step of causing the controllable pitch propeller to experience the desired change in the pitch. This would normally be done with a pitch controller mechanism which is dedicated to receiving pitch position commands from external components and implementing the pitch commands. Alternatively, the actual implementation of the pitch command can be controlled directly by an engine control unit which is the same component used to select the direction in magnitude of the pitch change as a function of the difference between the desired and actual engine operating condition, such as engine speed.

The method of the present invention can further comprise the step of measuring the actual magnitude of the pitch of the controllable pitch marine propeller and adding the desired change in the pitch of the controllable pitch propeller to the actual magnitude of the pitch in order to determine a desired pitch. The method can further comprise the step of causing the controllable pitch propeller to experience the desired change in the pitch, wherein the causing step causes the propeller to move directly to a position which satisfies the desired pitch of the controllable pitch marine propeller. It should be understood, however, that an alternative implementation of the present invention could comprise the steps of first determining the appropriate direction of a desired pitch change and then incrementally causing the propeller to move in predetermined stages in that desired direction until the engine operating condition achieved the desired magnitude. The precise method for implementing the pitch change is not limiting to, the present invention.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
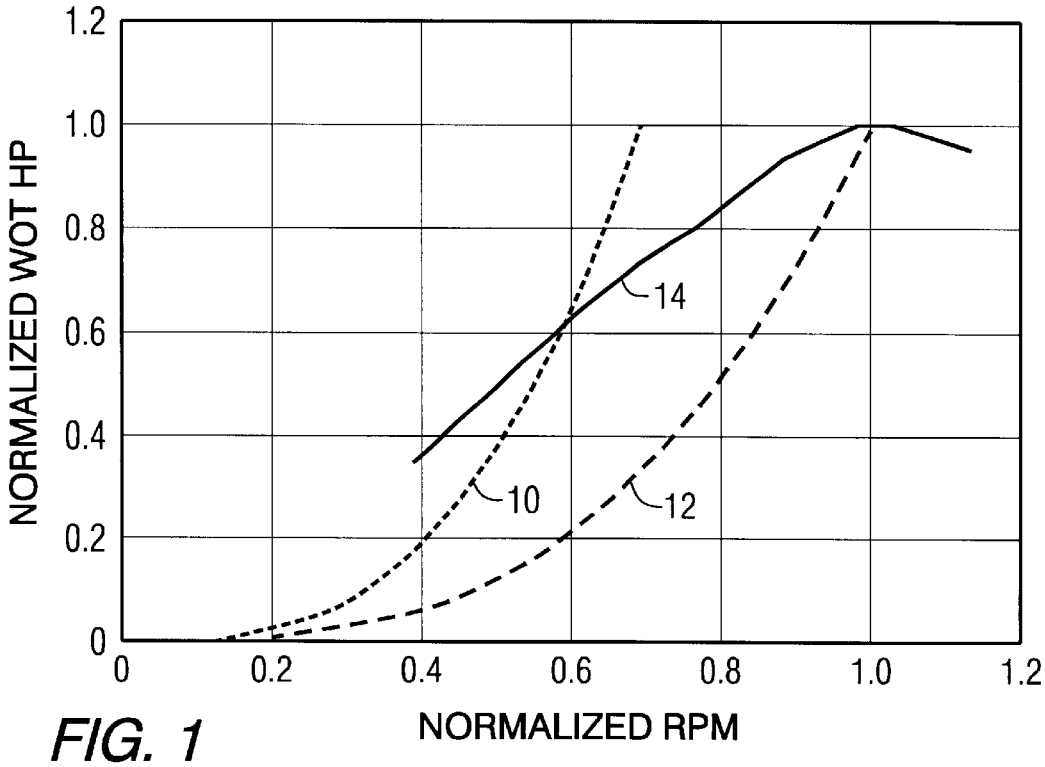
FIGS. 1 and 2 show various known operating conditions of existing marine propulsion systems.

Throughout the description of the preferred embodiment of the present invention, like components will be identified by like reference numerals.

Controllable pitch propellers have been developed for the purpose of optimizing various different performance attributes of planing craft at a wide range of operating speeds. Some of these applications of controllable pitch propellers require the manual control of the propeller pitch in addition to engine throttle control and this adds a level of complexity to the task of operating a pleasure craft. This added level of complexity may be unacceptable to many recreational boaters and it leaves the engine susceptible to potential damage from overspeed and overload conditions if the pitch is incorrectly selected by the operator. It would therefore be desirable if a pitch selection control system could be implemented in which the pitch is automatically selected as a function of the position of existing helm controls, such as a throttle control lever. Many types of marine engine systems now contain a computer or engine control module (ECM) and the microprocessor contained within the engine control module can be used to implement a control strategy for the controllable pitch propeller. However, it is also highly desirable that any type of pitch control system be easily adapted to existing engines even though those engines may not comprise sensors and electronic control systems, such as engine control modules.

Automatic pitch selections, in conjunction with controllable pitch propellers, have been proposed for large ships, but these systems are difficult to implement on a mass produced drive system for various reasons. The present invention provides an automatic selection system for pitch selection that adapts quickly and automatically to optimize acceleration, top speed, and cruise fuel economy with a simple algorithm that is easy to calibrate. The calibration is related to engine characteristics, rather than boat characteristics, and this makes a single system and calibration method applicable to a large variety of planing watercraft. If any portion of the calibration procedure is dependent on the specific watercraft, it is sufficiently simple and straightforward to be encapsulated in an autocalibration feature of the present invention. Alternatively, it can be captured with a single scalable adjustment parameter that can be manually adjusted by an installer or service technician. The pitch control algorithm of the present invention does not rely on predetermined combinations of pitch and engine speed but, instead, it dynamically adjusts pitch in response to changes in boat drag or weight so as to continuously optimize performance of the engine and drive system. Engine speed and/or pitch position are constantly checked in a closed loop control system in order to ensure that the desired operating condition is maintained. The present invention requires little information to be stored for the purpose of calibration and this makes the system easier to tune for any particular watercraft. Most of the characteristics of the calibration procedure are dependent on the engine alone and the scaling of the calibration is sufficiently straightforward to be incorporated in an automatic calibration algorithm or into a single user calibration parameter. The calibration process is also sufficiently straightforward to allow it to be automated within the controller itself, allowing the controller on each watercraft to learn its own calibration requirements.

The present invention utilizes relatively "clean" and reliable signals for pitch selection. These include engine speed which can be easily measured with a tachometer and throttle position that can easily be measured by a potentiometer or other types of throttle position sensors. One basic algorithm, provided by the present invention, can permit autocalibration and optimal acceleration, top speed, and cruise fuel economy control.

It has been observed that the acceleration of watercraft with conventional propellers is constrained by high propeller loads at boat speeds lower than top speed. As illustrated in FIG. 1, a propeller's required power, as a function of engine speed, typically rises by a factor of three or more as the boat speed is reduced from its maximum to a near zero or "bollard" condition. When this relationship is plotted with a typical engine wide open throttle (WOT) power versus engine speed curve, it can be seen that the high propeller load when the boat is at rest forces the engine/propeller system to a much lower operating engine speed than when the boat is moving at high speed. At this reduced engine speed, the engine is unable to deliver its peak output power. This reduced rate of energy transfer to the propeller limits the amount of thrust that can be produced and, as a result, limits the maximum rate of acceleration of the boat. In FIG. 1, dashed line 10 represents the "bollard" condition (100% slip) and dashed line 12 represents a peak efficiency condition. Solid line 14 represents empirical results of an actual engine of an outboard motor.

Figure 2:
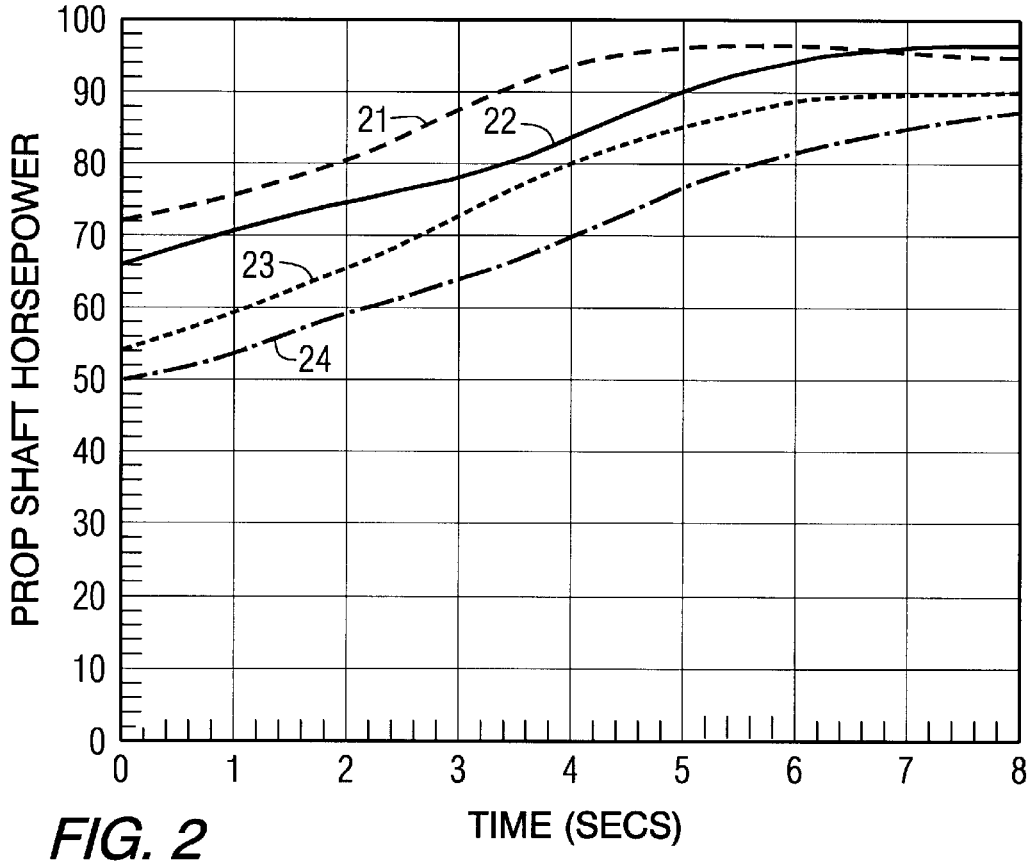

As illustrated in FIG. 2, a significant period of time is typically required for a planing watercraft to gain sufficient speed to reduce propeller load to a magnitude that allows the engine to reach its full rated power. The four lines, 21–24, shown in FIG. 2 represent four different engine/propeller combinations operated at a wide open throttle acceleration. It should be understood that the four lines, 21–24, shown in FIG. 2 are the result of a simulation.

Figure 3:
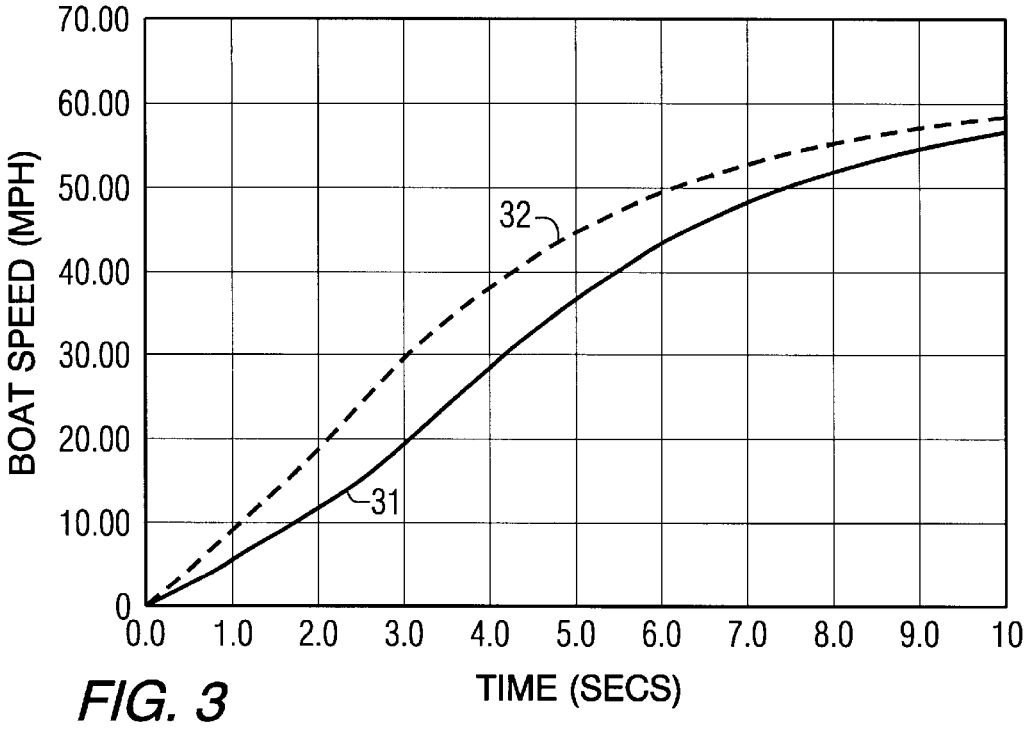
FIG. 3 compares the known operating characteristic of a fixed pitch propeller and the potential operating characteristic if the engine was operated at peak horsepower throughout its range.

FIG. 3 represents a computer simulation of the results of operating an outboard motor both at constant horsepower and peak engine power. Line 31 shows the boat speed of a theoretical watercraft operated with a 23 pitch propeller and at wide open throttle (WOT). Dashed line 32, on the other hand, shows the theoretical acceleration profile of a watercraft if peak engine power were available throughout the acceleration period. As can be seen, the acceleration time from a standstill condition to 30 miles per hour is reduced from slightly greater than four seconds to approximately three seconds. A controllable pitch propeller can overcome the disadvantages of a fixed pitch propeller by reducing pitch to the degree necessary to allow the engine to achieve full power at any boat speed. Optimal wide open throttle (WOT) acceleration from any boat speed up to a maximum speed can therefore be obtained with a controllable pitch propeller by adjusting the pitch to allow the engine to operate continuously at its peak power speed, as measured in revolutions per minute (RPM), when this type of improved acceleration is required.

Figure 4:
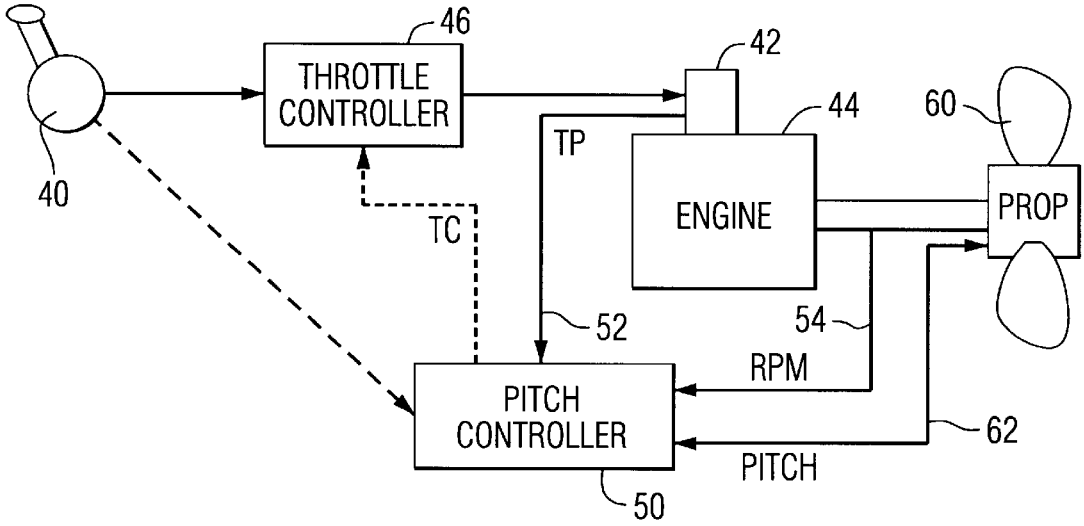
FIG. 4 is a simplified representation of a marine propulsion system incorporating the present invention.

FIG. 4 is a schematic representation of a marine propulsion system. The operator of a planing watercraft controls the speed of the watercraft by manually moving a throttle lever 40. In some applications, the throttle control lever 40 is connected directly to a throttle within a throttle body 42 of the engine 44. This connection can be a cable connected directly between the throttle control lever 40 and the throttle plate itself. Alternatively, a throttle controller 46 can be connected in signal communication with the throttle position lever 40 to receive signals from the throttle position lever and convert those signals to actual throttle position commands that are used to position the throttle plate within a throttle body 42. In certain types of marine engines, the actual position of the throttle plate in the throttle body does not vary directly with the angular position of the throttle control lever 40. Instead, an engine control unit incorporates a throttle controller 46 that causes the throttle plate to move in accordance with preselected algorithms that coordinate the throttle plate movement with the magnitude of fuel injected into each cylinder for each cycle of the engine, spark ignition timing, engine speed, barometric pressure, and other variables. The present invention can operate under either condition, with the throttle lever 40 being connected directly to the throttle plate by a cable or indirectly under the control of a throttle controller 46.

A pitch controller 50 receives a throttle position signal 52 either from the throttle plate within the throttle body 42 or, alternatively, directly from the throttle control lever 40. Engine speed is measured, typically by a tachometer, and provided as a signal 54 to the pitch controller 50. Using the throttle position and engine speed, the pitch controller 50 can determine the required pitch of the propeller 60 and cause the pitch to change to a desired pitch to achieve the engine speed corresponding to the position of the throttle control lever 40. Line 62 in FIG. 4 represents the signals from the pitch controller 50 to the propeller 60 and a return signal to the pitch controller 50 that represents the actual physical position of the pitch control mechanism within the hub of the propeller 60. The precise communication of signals between the components shown in FIG. 4 and the methodology for determining a desired pitch for the propeller 60 as a function of the input parameter received from the throttle control lever 40 will be described in greater detail below.

It has been observed that many recreational boaters can become confused by the sensitivity of propeller load to boat speed. This potential confusion also relates directly to the sensitivity of the engine and propeller speed to the speed of the watercraft. It is therefore considered beneficial to provide an operator interface which treats a throttle lever command from the throttle control lever 40 as a demand for a given engine power output, independent of boat speed. This input parameter is manually provided by the operator of the watercraft. Since, for a given atmospheric condition, engine power output at a given throttle position is a function of engine speed alone, engine speed can be used as an analog for engine power at any constant throttle position of the throttle control lever 40. Therefore, a controllable pitch propeller can provide the intended watercraft behavior by having the pitch control algorithm interpret a throttle position of the throttle control lever 40 or the throttle plate 42 as a command for a certain engine speed received from the operator of the watercraft. Correspondingly, the control system varies the propeller pitch at this constant throttle position in order to control the engine to that desired engine speed.

With continued reference to FIG. 4, throttle position sensors are commonly used in many types of modem electronically controlled engines. These throttle position sensors can incorporate potentiometers or Hall effect sensors. They provide a reliable signal and can readily be used as input to the pitch selection algorithm. These sensors are also relatively easy to retrofit to existing engines.

One embodiment of the present invention can incorporate a more sophisticated implementation of the concept of treating lever position as an engine power request and could vary the throttle position, propeller pitch, and engine speed simultaneously while maintaining a constant output power from the marine propulsion system. A minimum fuel consumption criterion might be used to select the throttle positions and engine speed in this type of algorithm. The preferred embodiment of the present invention varies only the propeller pitch in order to maintain a constant engine speed for any particular throttle position. This appears to be the simplest way in which to achieve the benefits of the present invention while effectively improving the operation of the marine propulsion system.

From the theory of the operation of propellers, it is possible to develop a means for estimating the magnitude of pitch change that is required to adjust the propeller speed, and engine speed, from one condition to another without direct knowledge of the actual velocity of the watercraft. The sensitivity of propeller thrust and torque, in response to the engine speed and the speed of the watercraft, is known to reduce to a basic function of the boat's advanced ratio, defined as the ratio of boat speed to propeller speed (RPM). Experiments have shown that boat speed changes much more slowly than engine speed (RPM) in response to a pitch change of a controllable pitch propeller. Therefore, the boat speed can be assumed to be constant during any propeller pitch change operation. Since boat speed can be considered to be constant during any pitch change procedure, the magnitude of the advanced ratio change required to produce a given engine speed change (RPM) is inversely proportional to the ratio of the desired engine speed (RPM) to the current engine speed (RPM). The geometry of propeller blade flows suggest that the ratio of the pitch change required for a particular engine speed change (RPM) is approximately equal to the ratio of the advanced ratio change. This result is expressed in equation 1 below, where "P" is the pitch, "r" is the effective radius of the propeller blades, "V" is the velocity of the watercraft, "n" is the rotational speed, and "D" is the diameter.

$$(P/2\pi r)\ (V/nD) \qquad 1$$

Since the watercraft velocity "V" remains unchanged during the pitch changing procedure, the pitch change associated with the desired engine speed (RPM) change is defined by equation 2 which is restated as equation 3 below.

$$P_{new}/P_0 = n_0/n_{target} \qquad 2$$

$$P_{new} = P_0(n_0/n_{target}) \qquad 3$$

As a result of the above relationships, the adjustment in pitch that is required to obtain a given engine speed (RPM) can be calculated by knowing only the present pitch "P" and the engine speed "n" (RPM). In equations 2 and 3, "$P_{new}$" is the required new pitch, "$P_0$" is the initial pitch prior to the pitch change procedure, "$n_0$" is the original engine speed (RPM), and "$n_{target}$" is the desired engine speed (RPM). Based on these relationships, a simple algorithm can be used which implements the idea of engine power control based on the throttle control lever position, in association with a controllable pitch propeller. The algorithm includes three basic elements. First, a set of engine speed magnitudes are associated with throttle positions and these relationships are stored in a microprocessor following a calibration procedure. It should be understood that the throttle position used to select the engine speed set points can be the actual throttle handle, or throttle control lever, manipulated by the boat operator or, alternatively, it can be the actual throttle plate position measured by an appropriate throttle position sensor. The second basic element of the algorithm is the reading of the current throttle position, or the current throttle plate position, so that this magnitude can be used to select the appropriate desired engine speed (RPM) set point from the table described above. The third element of the algorithm is to compare the actual or current engine speed (RPM) to the desired engine speed (RPM) selected from the table. The propeller pitch is then adjusted so as to drive the engine speed back to the desired engine speed set point (RPM). Equation 3, described above, can be useful in a feedforward control loop to accomplish these purposes. Other methods that are based on, for example, standard proportional-integral-differential (PID) algorithms can also be used for these purposes.

With reference to FIG. 4, the block diagram represents a controllable pitch propeller 60 and pitch adjustment mechanism that can be used to implement the strategy described above. The pitch controller 50 uses throttle position (TP) and either the engine or propeller shaft speed (RPM) to control the propeller pitch. In the implementation shown in FIG. 4, the actual propeller pitch is sensed and this information is used in generating the pitch control output that actually moves the linkages or other components that move the individual propeller blades about their associated axes. It should be noted that some implementations of the present invention do not have to rely on the knowledge of the actual current pitch position, but those alternative embodiments will not be described in the description of the preferred embodiment. A throttle controller 46 is shown in FIG. 4. This component maybe an electronic device or simply a mechanical linkage, such as a cable. If an electronic controller is used, the pitch controller 50 could generate a throttle correction signal (TC) in order to improve the precision of the engine speed-based control algorithm. This additional control capability could be used to better control the engine's fuel consumption or, alternatively, to provide an approximation to actual watercraft velocity control without actually measuring the boat speed.

With continued reference to FIG. 4, the intent of the preferred embodiment of the present invention is to implement a pitch controller 50 in software within an engine control module (ECM). This function can be accomplished as an additional process within the microprocessor of the engine control module and some additional wiring would be provided in order to connect to other components, such as sensors, and these connections could be enclosed within the existing engine wire harness. The pitch controller 50 could also be implemented in a stand alone processor as long as the data communication, which will be described below, is available. The controller pitch propeller system of the present invention could be installed on existing engines which do not have engine control modules by simply installing a processor dedicated for pitch control only. The sensor inputs required would include throttle position (TP) and engine speed (RPM). These sensors are commercially available and easily implemented, even on engines which do not have engine control modules. If the throttle linkage is mechanical, throttle position (TP) could be read from a sensor connected anywhere in the throttle linkage from the throttle control lever 40 to the actual throttle plate. For simplicity, the diagram shown in FIG. 4 illustrates pitch information moving between the pitch controller 50 and the propeller 60. In alternative embodiments, this information actually moves between the pitch controller 50 and some type of electromechanical pitch servo mechanism which receives commands from the pitch controller 50 and actually moves the blades to the commanded positions.

Within the pitch controller 50 shown in FIG. 4, the control strategy of the present invention can be implemented in several ways. All of these methods share common elements. The throttle position (TP) input is used to select an engine speed (RPM) set point from a table stored in a microprocessor memory. This determines the desired engine speed (RPM) as a function of the input parameter provided by the manually controllable lever 40. The pitch controller 50 then compares the desired engine speed (RPM) selected from the lookup table to the actual engine speed (RPM) measured by a tachometer or other similar device. If the actual engine speed is greater than the desired engine speed, the pitch of the propeller 60 is increased. Alternatively, if the actual engine speed is below the desired engine speed, the pitch of the controllable pitch propeller is decreased. In a preferred embodiment of the present invention, the throttle position input is also compared to a preselected value to determine whether or not an idle pitch setting should be used instead of the basic strategy implemented by the pitch controller 50. This will be described in greater detail below. The operation of the present invention in non idle speed circumstances will be described below, followed by a discussion of how the present invention would be implemented when an idle speed setting is provided by the operator of the watercraft, as determined by the position of the throttle control lever 40.

Figure 5:
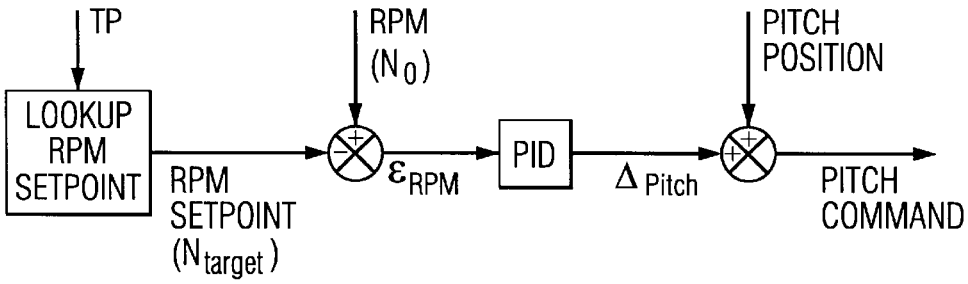
FIGS. 5–9 show various control algorithms incorporating PID control methods.

Several methods for determining the amount of pitch adjustment required for a given change in engine speed (RPM) have been developed. First, standard PID control methods which are well known to those skilled in the art can be used and empirically calibrated to provide reasonably good implementation of the present invention. FIG. 5 shows a conventional control loop of a type that can be used to implement the concepts of the present invention. In the control loop of FIG. 5, the difference between the actual engine speed and the desired engine speed is input to a standard PID control algorithm to produce a pitch correction. The operation of the control algorithm can be tuned, for specific applications, by adjusting the magnitude of the standard proportional, integral, and derivative gains. In practice, this type of system shown in FIG. 5 has been shown to have less than optimal performance in association with controllable pitch propellers in marine applications. Stability of the system under proportional control has been demonstrated to be less than optimal and this characteristic forces the use of high integral gains. The use of high integral gains, in turn, result in slower pitch control than desired. The reasons for these inadequacies can be seen in an extension of the theoretical analysis discussed above.

Conventional proportional-integral-derivative (PID) control methods are typically described in terms of dependent and independent variables which approach zero as the system approaches a steady state condition. Equation 6 is a restatement of equation 3, described above, in terms of pitch and engine speed (RPM) errors.

$$\Delta_{Pitch}=P-P_0 \quad (4)$$

As shown above, equation 4 defines the necessary change in pitch "$\Delta_{pitch}$" in terms of the desired pitch "P" and the initial pitch "$P_0$". In addition, equation 5 defines the desired change in engine speed "$\epsilon_{RPM}$" in terms of the initial actual engine speed "$N_0$" and the desired engine speed "$N_{target}$".

$$\epsilon_{RPM}=N_0-N_{target} \quad (5)$$

$$\Delta_{Pitch}=\epsilon_{RPM}(P_0/N_{target}) \quad (6)$$

Figure 6:
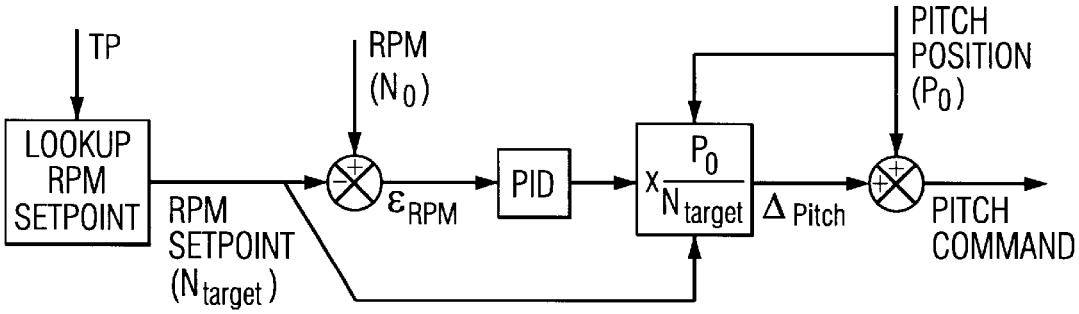

From equations 4 and 5, equation 6 restates the relationship between the required change in pitch "$\Delta_{Pitch}$" in terms of the desired change in engine speed "$\epsilon_{RPM}$" and the ratio between the initial pitch "P" and the desired engine speed "$N_{target}$". With reference to equations 4, 5, and 6, it can be seen that the physics of fluid flow past the propeller indicate the pitch correction is expected to scale directly with the engine speed error "$\epsilon_{RPM}$". This behavior is provided by the standard PID control method illustrated in FIG. 5. However, the physical model also suggests that the magnitude of the pitch correction "$\Delta_{Pitch}$" should scale directly as the present pitch setting "$P_0$" and inversely with the desired engine speed "$N_{target}$". Standard PID methods do not normally provide for this scaling. Instead, the control method represented in FIG. 5 provides a single magnitude of pitch correction for a given engine speed error, regardless of the present pitch setting or desired engine speed. This difference affects the stability and tunability of the control system. In order to be applicable to controllable pitch propeller systems without the scaling correction, stable control was difficult to establish and required high integral gains which resulted in slow response of the pitch and engine speed changes for changing throttle positions. FIG. 6 illustrates a block diagram of a pitch controller that implement the pitch and engine speed scaling corrections discussed above.

During the development of the control algorithm of the present invention, two additional features were considered. These additional features are illustrated in the control algorithm shown in FIG. 7. A "feedforward" pitch setting is added, as a lookup table, indexed by throttle position. This permits the algorithm to respond in a way similar to a fixed pitch propeller mixed with a variable pitch control output and, as a result, it allows the response of the system to be easily tuned to feel more like a standard propeller to the operator of a watercraft.

Figure 7:
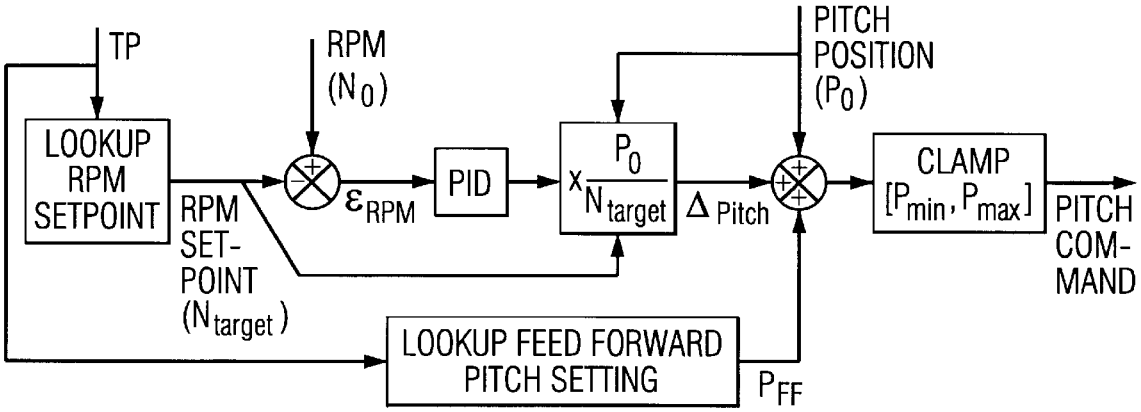

FIG. 7 illustrates a control algorithm with an additional "clamping" step. This forces the pitch command output to remain between distinct minimum and maximum values that are able to be calibrated. This step overcomes problems with pitch scaling in circumstances where the pitch decreases to zero. It is also useful in preventing wasted effort in the mechanism receiving the pitch command by ensuring that the commands are always within its acceptable range of motion.

Figure 8:
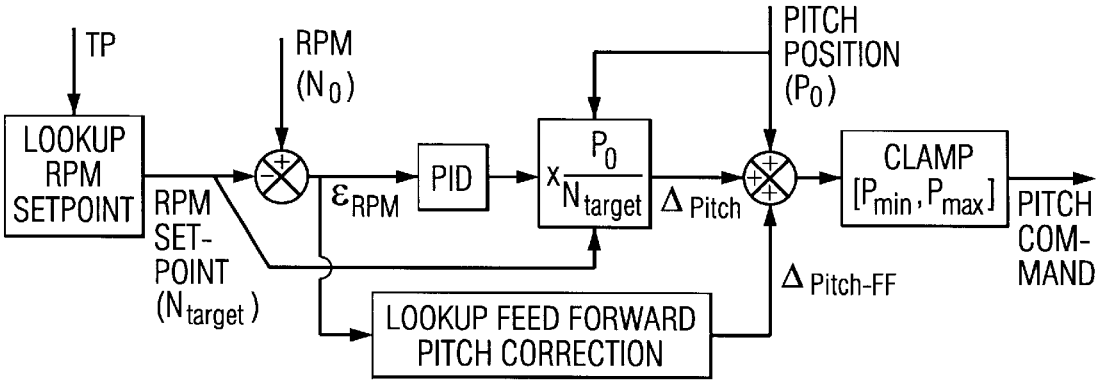

It should be clearly understood that alternative strategies for performing the method of the present invention are also available. One potentially attractive strategy is illustrated in FIG. 8. A pitch correction magnitude is selected from a preset table that is based on the current actual engine speed (RPM) error. This methodology can provide more rapid and stable pitch response to a sudden change in throttle position than would normally be possible with the other strategies described above in conjunction with FIGS. 5, 6, and 7.

When properly calibrated, the control strategies described above in conjunction with FIGS. 5–8 provide good control of engine speed (RPM) at speeds above idle speed. However, at idle speed the hydrodynamic load on the propeller becomes relatively small and, on electronically controlled engines, a separate engine idle speed controller typically becomes active. The idle speed controller usually adjusts air flow, ignition, fuel flow, and other variable in order to govern the engine's idle speed to a preselected value. This type of system could potentially conflict with the controllable pitch propeller control system in order to govern engine speed at idle. Since the engine controls are typically more effective than propeller load at low speed, propeller pitch behavior will tend to become unstable if the idle speed controller and pitch controller are both simultaneously active in attempting to control the engine speed at idle speeds. Judicious choice of the engine speed set point, or the desired engine speed, at the idle throttle position can stabilize pitch by forcing it to remain at the upper or lower bound of the pitch range. However, some undesirable effects still remain in this situation. One of these undesirable effects is the reduction in braking force during deceleration of the watercraft as the propeller goes to high pitch in an attempt to reduce engine speed quickly to the new desired engine speed (RPM) set point value. These problems can be overcome by using a different pitch control strategy when the throttle closes to the idle position. One acceptable strategy simply uses a fixed and calibratable pitch setting at idle engine speeds. As an additional benefit, this same strategy allows control over braking forces during deceleration. If the operator of the watercraft decelerates by moving the throttle control 40 back to a position just above idle speed, the high speed pitch control algorithm remains active and will tend to maintain the pitch at a higher pitch position. This provides relatively low braking force on the watercraft, but improves fuel economy. If the throttle is closed completely to the idle position, the idle pitch algorithm becomes active and reduces the pitch to the idle setting. This provides increased braking on the watercraft.

Figure 9:
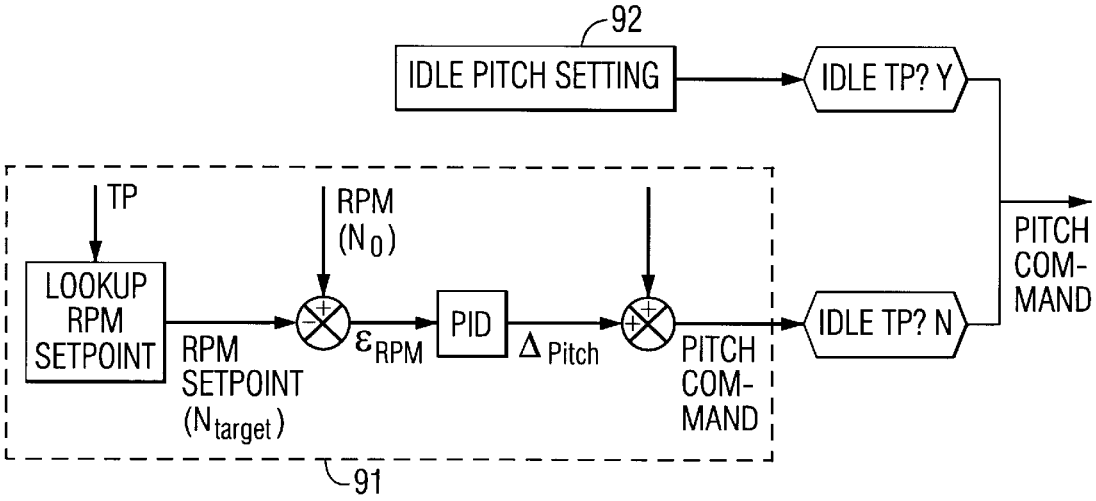

A block diagram of the pitch controller is illustrated in FIG. 9. Dashed box 91 illustrates the pitch control algorithm that is used when the throttle position, manually controlled by the operator, is not in the idle position. Box 92 illustrates a specific idle pitch setting portion of the algorithm that is implemented when the operator moves the throttle control lever 40 to the idle setting. In a typical application of the algorithm sown in FIG. 9, the idle pitch setting 92 is a fixed pitch that is determined independently from the actual engine speed (RPM) and, instead, is selected because the input parameter provided by the manually controllable throttle lever 40 is at a position defined as an idle position.

Figure 10:
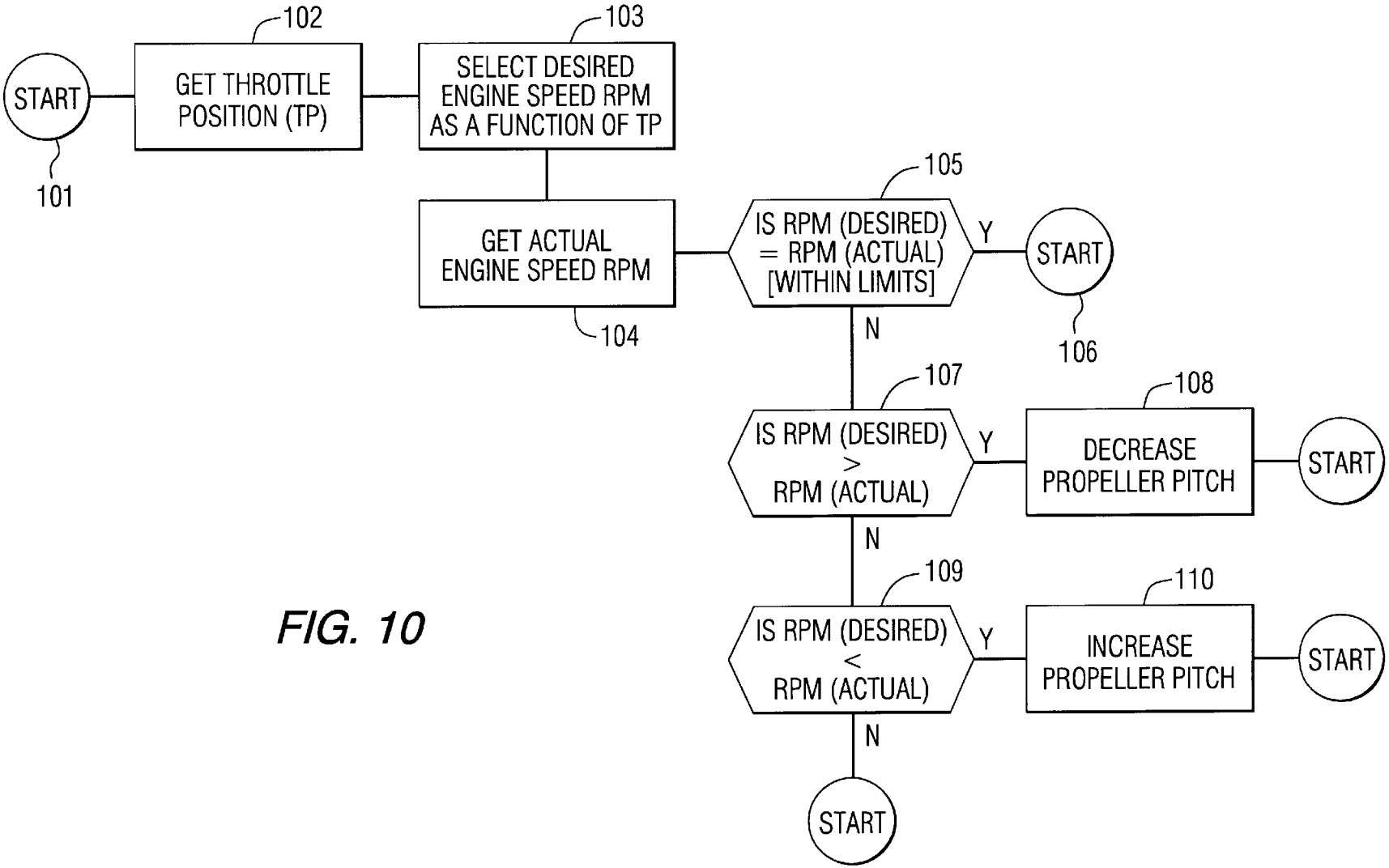
FIG. 10 is a simplified flow chart showing one implementation of the present invention.

FIG. 10 is a simplified flow chart showing the individual actions taken during implementation of the method of the present invention. It should be realized that many different software programs can be used to accomplish the method of the present invention, but the flow chart shown in FIG. 10 is one system that can be used. Starting at functional block 101, the program first gets a throttle position (TP) at functional block 102. This throttle position magnitude can be directly related to the manually controllable throttle lever 40 described above in conjunction with FIG. 4 or, alternatively, from a throttle position sensor associated with the actual throttle plate of the engine 44. The program then selects a desired engine speed at functional block 103 as a function of the throttle position. This selection can be performed by the program choosing a predetermined engine speed from a table in which a plurality of engine speeds are each associated with a plurality of throttle positions. The desired engine speeds (RPM) is chosen as a function of the throttle position. At functional block 104, the program accesses the actual engine speed (RPM). This can be accomplished through the use of a tachometer. It should be understood that the speed can alternatively be the speed of rotation of the propeller itself. Since the propeller is typically rotating at the same speed as the output shaft of the engine, either speed can be used for these purposes.

At functional block 105, the desired speed is compared to the actual speed to see if these two magnitudes are equal to each other within an acceptable tolerance band. If they are, no pitch change is required and the program returns to the start, as indicated by functional block 106. If the desired speed is not equal to the actual speed, the desired and actual speeds are compared to determine which is larger. If the magnitude of the desired engine speed is greater than the magnitude of the actual engine speed, as determined by functional block 107, the program decreases the propeller pitch as indicated by functional block 108 and then repeats the process. In the simplified flowchart shown in FIG. 10, the decrease in propeller pitch at functional block 108 can be a relatively small incremental decrease that is implemented each time functional block 107 determines that the desired speed is greater than the actual speed. Alternatively, it should be understood that the final desired pitch setting can be mathematically determined and commanded in one complete movement of the controllable pitch propeller.

If the interrogation at functional block 107 does not indicate that the desired engine speed is greater than the actual speed, these two magnitudes are compared at functional block 109 to determine if the desired engine speed is less than the actual engine speed. If it is, the propeller pitch is increased at functional block 110. As discussed above in conjunction with functional block 108, functional block 110 can implement a relatively small incremental pitch change each time functional block 109 determines that the desired speed is less than the actual speed. Alternatively, as described above, the total pitch movement can be caused to occur in one continuous step.

Figure 11:
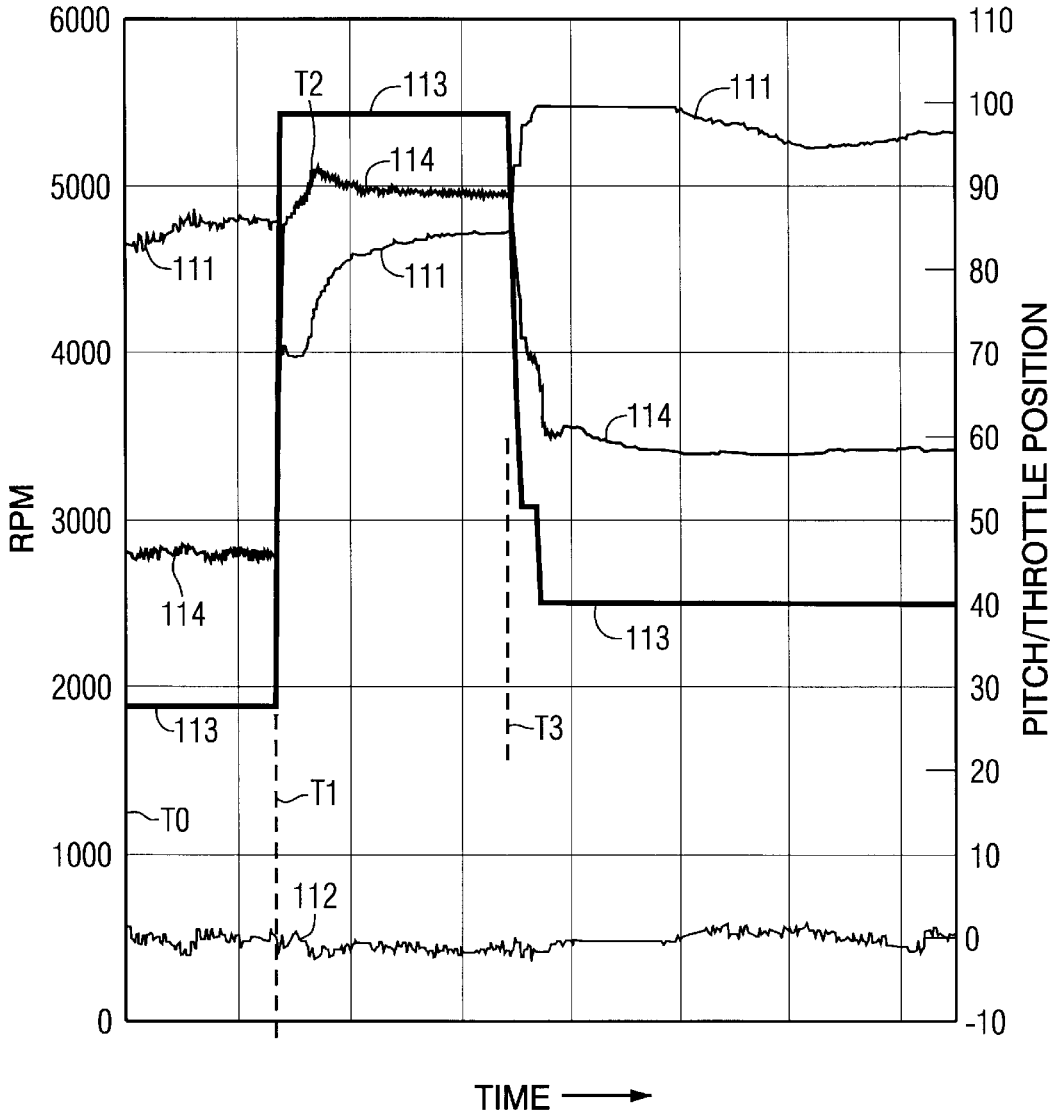
FIG. 11 is a graphical representation of engine speed, pitch selection, and throttle position.

The performance of the present invention is illustrated in FIG. 11. FIG. 11 is a graphical representation of the reaction of the control system of the present invention during rapid acceleration and deceleration. Line 111 is the desired pitch setting determined by the present invention and transmitted to the mechanism that actually changes the pitch of the controllable pitch propeller. Line 112 represents the instantaneous pitch error which is the difference between the actual pitch position and the desired pitch position. Line 113 in FIG. 11 represents the throttle position sensor which indicates the magnitude of the input parameter representing the position of the manually controllable throttle lever 40. The actual engine speed is represented by line 114. In FIG. 11, prior to time T1, the throttle position 113 is relatively constant at approximately 28% of wide open throttle (WOT). The engine speed 114 is also relatively constant except for slight variations resulting from the normal operation of the engine control module and its control of parameters affecting the engine speed. The desired pitch 111 changes slightly in this period in order to maintain a relatively constant engine speed 114. As can be seen by line 112, the difference between the desired pitch 111 and the actual pitch is relatively small throughout the period illustrated in FIG. 11.

Beginning at time T1, a rapid change in the throttle position sensor 113 occurs, with the throttle position changing from approximately 28% of wide open throttle to wide open throttle of 100%. The desired pitch 111 immediately drops from approximately 87% to a magnitude slightly above 70%, as illustrated by the change in line 111 immediately before and immediately after time T1. This rapid decrease in desired itch setting, which is quickly followed by actual pitch setting in view of the relatively small pitch error 112, results in a rapid increase in engine speed 114 as can be seen by comparing the engine speed 114 immediately before and immediately after time T1. After a slight overspeed condition at time T2, the engine speed 114 is maintained at 5,000 RPM as the desired pitch 111 increases reactively between time T1 and time T3, with the desired pitch setting being generally constant at approximately 86%.

At time T3, the throttle position sensor indicates a rapid reduction in the throttle position lever 40, from wide open throttle to approximately 40% of wide open throttle (WOT). This sudden decrease in throttle position is immediately followed by a sudden increase in the desired pitch 111 to maximum pitch. As a result, the engine speed 114 quickly reduces to approximately 3500 RPM. When the engine speed 114 stabilizes, the desired pitch 111 is slowly reduced to a magnitude between 95% and 97%.

FIG. 3 graphically illustrates the rapid response of a controllable pitch propeller system and the ability of the system to maintain engine speeds at relatively constant magnitudes as a function of the position of the throttle lever 40. For example, between time T0 and T1, engine speed 114 is maintained at a relatively constant 2800 RPM in response to the throttle position sensor 113 being constant. The sudden change in throttle position sensor at time T1 is immediately responded to by a sudden decrease in desired pitch 111 and this sudden change in the propeller pitch causes a sudden increase in engine speed 114. When the throttle position sensor 113 is suddenly reduced at time T3, a sudden increase in desired pitch 111 causes the engine speed 114 to drop. The overall responsiveness and stability of the present invention can be seen by observing the interrelationships of the various graphical representations in FIG. 11.

Many different types of calibration schemes can be used in accordance with the present invention. These calibration schemes can be tailored to suit different boat types and different operating characteristics of the watercraft. The present invention provides a beneficial result because it allows the controllable pitch algorithm to characterize the required calibration based on a single parameter in combination with certain known curve characteristics.

Figure 12:
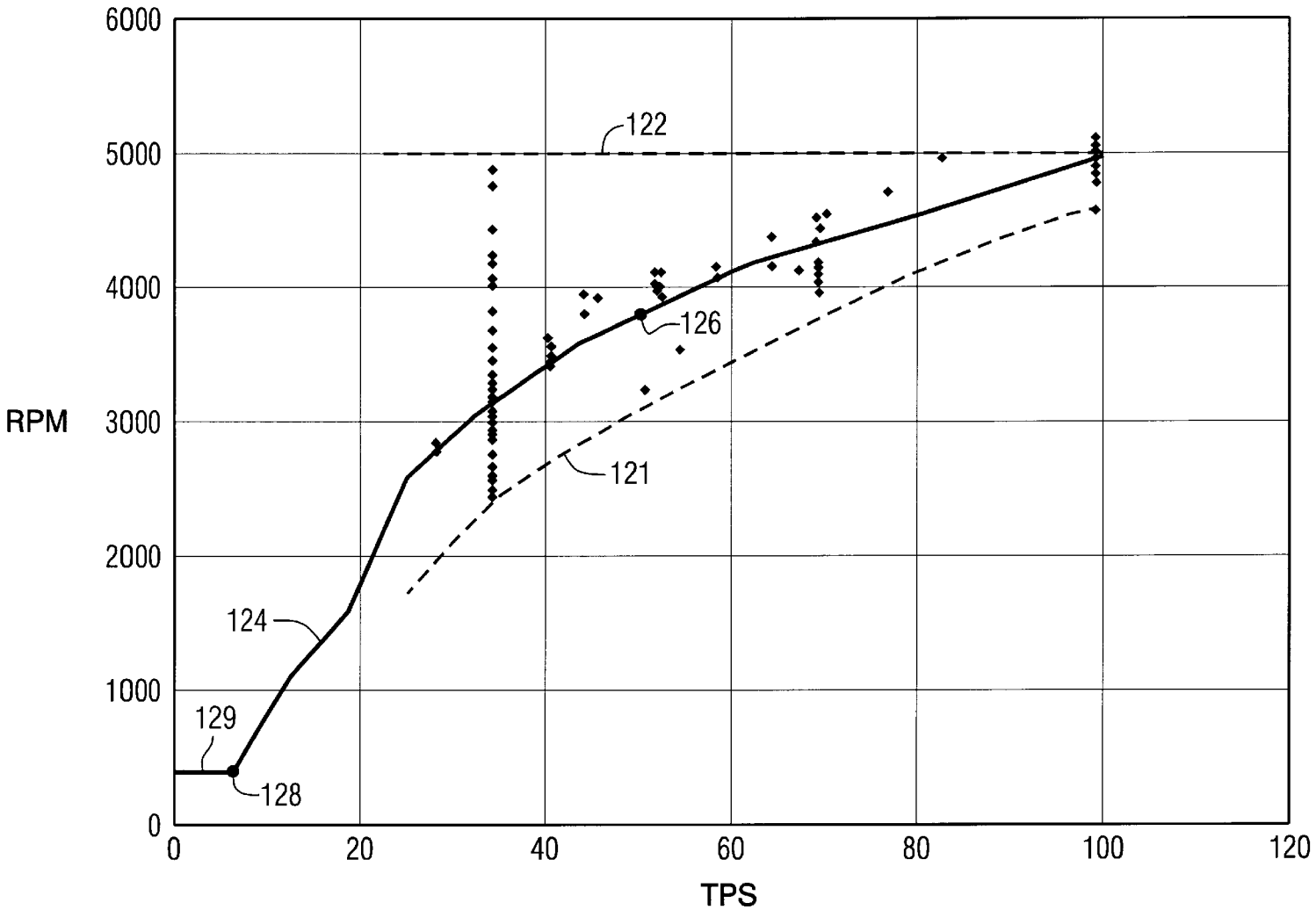
FIG. 12 shows a typical calibration relationship between engine speed and throttle position.

FIG. 12 shows the relationship between engine speed and throttle position. One possible parameter that can be used is "mean propeller pitch" which is used to define the pitch of a standard propeller that would be used on a particular watercraft. With this information as an input, a calibration routine could generate a proper propeller calibration for the algorithm. As a result, a calibration stored in the engine stored in the engine control module (ECM) could automatically adjust the pitch at one or more selected throttle positions in order to determine the appropriate values for the engine speed (RPM) set points and then generate the complete calibration curve. FIG. 12 is a graphical representation of this process. Dashed line 121 represents the relationship between engine speed (RPM) and throttle position that results from the controllable pitch propeller being set to a position of maximum pitch. Dashed line 122 represents the maximum engine speed, as limited by an overspeed protection mechanism. If numerous different pitch settings are each run at certain discrete throttle positions, various set points can be selected so that the calibration mathematics in the program can perform a curve fitting procedure to determine the appropriate set points for the algorithm, as represented by solid line 124. The numeric values represented by line 124 are the engine speed set points, or desired engine speed magnitudes, used by the algorithm of the present invention for the various throttle positions represented by the horizontal axis in FIG. 12. As an example, if the throttle position is set at 50%, point 126 indicates that the algorithm of the present invention would regulate engine speed to approximately 3700 RPM. For each throttle position, a representative engine speed can be stored in the microprocessor and selected during the operation of the watercraft.

With continued reference to FIG. 12, it can be seen that at a throttle position below 10%, as represented by point 128, a constant engine speed is maintained as a minimum engine speed. As a result, movement of a throttle position lever 40 to a 0% position will not reduce the engine speed below the minimum represented by line segment 129 in FIG. 12. This maintains the engine speed discussed above in conjunction with the idle pitch setting 92 in FIG. 9.

As described above, the present invention provides a method for selecting the pitch position for a controllable pitch propeller as a function of an input parameter, such as throttle position. The throttle position magnitude is used by the algorithm of the present invention to select a desired engine speed from a predetermined table. As described above in conjunction with equations 1–6, a pitch setting can be calculated as a function of the current actual engine speed, the desired engine speed selected from the table as a function of throttle position, and the current actual pitch position. Various different types of control algorithms were discussed in conjunction with FIGS. 5–9 to implement these control strategies. The selection of any particular algorithm is determined by the operational characteristics of a particular watercraft in combination with a particular marine propulsion system. The flow chart of FIG. 10 describes a simple algorithm that can be used to accomplish these purposes. In response to any movement of a throttle position lever 40, the control algorithm of the present invention immediately changes pitch to cause the engine to operate at a desired engine speed determined by the throttle lever or throttle plate position. Engine speed is maintained at a constant magnitude whenever the throttle lever is stationary. Although the present invention has been described with particular detail and illustrated to show several embodiments, it should be understood that alternative embodiments are also within its scope.

We claim:

1. A method for selecting the pitch of a controllable pitch marine propeller of a planing watercraft, comprising the steps of:

determining a magnitude of an input parameter;

selecting a desired magnitude of an engine operating characteristic as a function of said input parameter;

measuring an actual magnitude of said engine operating characteristic; and determining a desired change in the pitch of said controllable pitch propeller as a function of the difference between said desired magnitude of said engine operating characteristic and said actual magnitude of said engine operating characteristic.

2. The method of claim 1, further comprising:

causing said controllable pitch propeller to experience said desired change in the pitch of said controllable pitch propeller.

3. The method of claim 2, wherein:

said engine operating characteristic is engine speed; and said causing step comprises the alternative steps of either increasing said pitch of said controllable pitch propeller when said desired magnitude of said engine operating characteristic is less than said actual magnitude of said engine operating characteristic or decreasing said pitch of said controllable pitch propeller when said desired magnitude of said engine operating characteristic is greater than said actual magnitude of said engine operating characteristic.

4. The method of claim 1, wherein:

said input parameter is a manually controlled input parameter.

5. The method of claim 4, wherein:

said manually controlled input parameter is a throttle lever position.

6. The method of claim 1, wherein:

said input parameter is a throttle plate position.

7. The method of claim 1, further comprising:

measuring an actual magnitude of said pitch of said controllable pitch marine propeller; and adding said desired change in the pitch of said controllable pitch propeller to said actual magnitude of said pitch of said controllable pitch marine propeller to determine a desired pitch of said controllable pitch marine propeller.

8. The method of claim 7, further comprising:

causing said controllable pitch propeller to experience said desired change in the pitch of said controllable pitch propeller, wherein said causing step causes said propeller to move directly to a position which satisfies said desired pitch of said controllable pitch marine propeller.

9. The method of claim 1, wherein:

said engine operating parameter is engine speed.

10. The method of claim 1, wherein:

said measuring of said actual magnitude of said engine operating characteristic is performed by a tachometer.

11. The method of claim 1, wherein:

said change in the pitch of said controllable pitch propeller is determined as a function of a calculated difference between said actual magnitude of said engine operating characteristic and said desired magnitude of a engine operating characteristic multiplied by the ratio of an actual magnitude of said pitch of said controllable pitch marine propeller to said desired magnitude of a engine operating characteristic.

12. The method of claim 1, wherein:

said desired magnitude of a engine operating characteristic is selected from a table, said table comprising a plurality of magnitudes of said engine operating characteristic associated with a plurality of magnitudes of said input parameter.

13. A method for selecting the pitch of a controllable marine pitch propeller of a planing watercraft, comprising the steps of:

determining a magnitude of an input parameter;

selecting a desired magnitude of an engine operating characteristic as a function of said magnitude of said input parameter;

measuring an actual magnitude of said engine operating characteristic;

determining a desired pitch change direction as a function of said desired magnitude and said actual magnitude of said engine operating characteristic; and determining a magnitude of a pitch change to be applied to said controllable pitch propeller in said desired pitch change direction.

14. The method of claim 13, wherein:

said pitch change magnitude is a preselected fixed magnitude.

15. The method of claim 13, further comprising:

determining an actual magnitude of said pitch of said controllable pitch marine propeller, said pitch change magnitude being determined as a function of a difference between said actual magnitude and said desired magnitude of said engine operating characteristic multiplied by the ratio of said actual magnitude of said pitch of said controllable pitch marine propeller to said desired magnitude of a engine operating characteristic.

16. A method for selecting the pitch of a controllable pitch marine propeller of a planing watercraft, comprising the steps of:

determining a magnitude of a manually controlled input parameter;

selecting a desired magnitude of a engine operating characteristic as a function of said manually controlled input parameter;

measuring an actual magnitude of said engine operating characteristic;

determining a desired change in the pitch of said controllable pitch propeller as a function of the difference between said desired magnitude of said engine operating characteristic and said actual magnitude of said engine operating characteristic;

measuring an actual magnitude of said pitch of said controllable pitch marine propeller; and adding said desired change in the pitch of said controllable pitch propeller to said actual magnitude of said pitch of said controllable pitch marine propeller to determine a desired pitch of said controllable pitch marine propeller, said engine operating characteristic being engine speed, said causing step comprising the alternative steps of either increasing said pitch of said controllable pitch propeller when said desired magnitude of said engine operating characteristic is less than said actual magnitude of said engine operating characteristic or decreasing said pitch of said controllable pitch propeller when said desired magnitude of said engine operating characteristic is greater than said actual magnitude of said engine operating characteristic.

17. The method of claim 16, further comprising:

causing said controllable pitch propeller to experience said desired change in the pitch of said controllable pitch propeller.

18. The method of claim 17, wherein:

said input parameter is a throttle plate position.

19. The method of claim 18, wherein:

said change in the pitch of said controllable pitch propeller is determined as a function of a calculated difference between said actual magnitude of said engine operating characteristic and said desired magnitude of a engine operating characteristic multiplied by the ratio of an actual magnitude of said pitch of said controllable pitch marine propeller to said desired magnitude of a engine operating characteristic.

20. The method of claim 18, wherein:

said desired magnitude of a engine operating characteristic is selected from a table, said table comprising a plurality of magnitudes of said engine operating characteristic associated with a plurality of magnitudes of said input parameter.

* * * * *